US011470876B2

(12) United States Patent
Zouev

(10) Patent No.: US 11,470,876 B2
(45) Date of Patent: Oct. 18, 2022

(54) HOOKAH ASSEMBLY AND COMPONENTS OF THE HOOKAH ASSEMBLY

(71) Applicant: MVA Canada Inc, Concord (CA)

(72) Inventor: Alexander Zouev, Georgetown (CA)

(73) Assignee: MVA CANADA INC

( * ) Notice: Subject to any disclaimer, the term of this patent is extended or adjusted under 35 U.S.C. 154(b) by 292 days.

(21) Appl. No.: 16/773,945

(22) Filed: Jan. 27, 2020

(65) Prior Publication Data

US 2021/0145046 A1 May 20, 2021

Related U.S. Application Data

(63) Continuation-in-part of application No. 29/713,336, filed on Nov. 15, 2019.

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS 7,806,123 B2 * 10/2010 Mehio ..... A24F 1/30 131/201
2011/0186060 A1 * 8/2011 Saleh ..... A24F 1/30 131/173
2020/0120976 A1 * 4/2020 Liu ..... A24F 1/30

* cited by examiner

*Primary Examiner* — Dennis R Cordray
(74) *Attorney, Agent, or Firm* — Merek, Blackmon & Voorhees, LLC

(57) ABSTRACT

A hookah or hookah assembly preferably having a lid including one or more sealing members that seal and releasably lock the lid to a liquid retaining tank such that when lid is connected to the liquid retaining tank the lid and liquid retaining tank can be moved as a unit by gripping any portion of the lid or the tank. The hookah preferably includes one or more openings that allow vapor to be exhausted through one or more openings formed in the lid. The hookah preferably includes a seal operably connected to a lower surface of the lid and engages an upper and horizontally extending surface of the liquid retaining tank. The hookah may include a down stem which has an integral diffuser configured to significantly reduce the operational noise level of the hookah while significantly reducing the number of openings necessary in the diffuser to achieve quite operation of the hookah.

20 Claims, 16 Drawing Sheets

HOOKAH ASSEMBLY AND COMPONENTS OF THE HOOKAH ASSEMBLY

FIELD OF THE INVENTION

Preferred forms of the present invention are directed to a hookah assembly and components of the hookah assembly that allow one or more individuals to smoke a smokable material such that the vapor of the smokable material is filtered by or through a liquid (e.g., water) prior to the one or more individuals inhaling the smokable material. The hookah assembly and components thereof are preferably configured to provide a low profile and/or compact hookah assembly that can be readily disassembled for cleaning and/or storage. The low profile and/or compact configuration allows the hookah assembly to be stored and/or used in a small space.

A preferred form of hookah assembly includes a sealing assembly that seals and locks a removable lid/tank top to a liquid retaining tank or housing member that during uses houses a liquid (e.g., water) that acts to filter the material being smoked. The removable tank top or lid includes an inner annular seal or interior peripheral seal that contacts an upper/horizontal surface of the tank body. The inner annular seal of the lid surrounds and engages a metallic vertically extending interior peripheral/annular lip of the lid which extends into the interior space defined by the liquid retaining tank or housing member. The tank top preferably includes an o-ring and a protective covering member located at each of the four corners or corner sections of the opening of the tank or housing member. The o-rings seal the corners and releasably lock the tank lid to the tank or housing member so that the lid and housing member can be lifted as a single unit by gripping any portion of the lid or any portion of the housing member.

The hookah assembly preferably includes a down stem that includes an integral diffuser. In a most preferred form, the lower portion of the down stem includes a plurality of annular grooves (e.g., three annular grooves) having a groove width or height that is configured or dimensioned to receive an o-ring. A plurality of bores/openings are spaced around and extend horizontally through each of the annular grooves. The diameter of each of the horizontally extending openings/bores is preferably greater than the width/height of the annular groove so that when an o-ring is seated in a corresponding annular groove or recess each horizontally extending opening/bore is divided or separated into two smaller bores/openings (i.e., an upper opening/bore and a lower opening/bore). The smaller sized openings/bores created by this configuration ensures that the hookah assembly will be quieter during operation while reducing by half the number of openings/bores that need to be formed in the diffuser portion of the down stem to achieve quieter operation of the hookah assembly. The down stem includes a ball valve moveable vertically in an internal bore of the down stem to isolate the material being smoked during a purge or exhaust step or process. A removable o-ring retains the ball valve in the internal bore of the down stem.

The hookah assembly includes a plurality of purge/exhaust slots or openings formed in the tank lid or top allowing purging of any residual vapor directly through an upper/horizontal surface of the tank lid or top. In a most preferred form, four arcuate purge slots are equally spaced about an upper, annular protruding portion of a mount for the tobacco bowl/head. The lower portion of the bowl mount includes a large annular member including an annular or peripheral lip that is tapered/inclined outwardly and a recessed interior seating surface having four vertically extending purge valve bores/passageways extending therethrough. Each valve bore/passageway has an upper opening having a size configured to receive a sealing ball or other sealing element and a lower opening having a size configured to retain the sealing ball or other sealing element, i.e., the upper opening is larger than the corresponding sealing element and the lower opening is smaller than the corresponding sealing element. Each of the valve bores/passageways is vertically aligned with one of the purge slots or openings formed in the lid. Between adjacent valve bores/passageways is a fastener bore for allowing a portion of a corresponding fastener to extend through the fastener bore/passageway. The lower surface of the lid includes a downwardly extending annular member having a central opening for receiving the upper, annular protruding portion of the bowl mount. The annular member of the lid includes an inclined peripheral or annular wall/lip configured to mate with the interior surface of annular lip of the bowl mount. The downwardly extending annular member of the lid further includes four arcuate recesses one of which is aligned with and in communication with each of the purge slots or openings. The four recesses are separated by a horizontally extending lower surface having an internally threaded bore for receiving a portion of a corresponding fastener. Each of the four recesses may be defined at least in part by a vertically inclined inner wall portion. The above described components of the lid and the bowl support create an exhaust or purge valve assembly spaced inwardly of the metallic vertically extending lip or wall of the removable lid.

The lid of the hookah assembly preferably has a connector for connecting the hookah assembly to an inhalation tube, hose or conduit which is formed as one piece with an upper surface of the tank top and a lower metallic chamber that communicates with the hose connector and extends into the tank or housing member wherein at least three sides of lower metallic chamber are spaced inwardly from any sealing element. The tank or housing member can have beveled, arcuate or rounded interior surfaces to facilitate cleaning.

In a most preferred form, the tank or housing member includes a main body or main section formed from a single piece of bent transparent plastic sealing connected to opposing sidewalls. The upper surface of the main body is offset inwardly from uppermost surfaces of the opposing sidewalls. The lower surface of the main body is offset inwardly from lowermost surfaces of the opposing sidewalls. Each opposing sidewall can be provided with an annular protective member (e.g., rubber annular foot) that extend around and engages the sidewalls and prevents sliding of the unit as well as prevent the unit from marking a supporting structure that the hookah assembly is placed on during storage or use. The inwardly offset surface of the tank or housing member allows the tank top or lid to fit in and be protected by the annular rubber feet and reduces the size of the unit.

BACKGROUND OF THE INVENTION

A hookah is a known device that one or more individuals can use to smoke a smokable substance (e.g., tobacco). A hookah can be a single or multi-stemmed instrument for vaporizing and smoking tobacco (flavored or non-flavored) or other substance where the smoke or vapor is passed through a water basin or other liquid retaining structure before being inhaled by an individual.

OBJECTS AND SUMMARY OF THE INVENTION

An object of a preferred form of the present invention is to provide a novel and unobvious hookah or hookah assembly.

Another object of a preferred form of the present invention is to provide an hookah assembly having a down stem that includes an integral diffuser that is configured to significantly reduce the operational noise level of the hookah assembly while significantly reducing the number of holes or openings that need to be formed in the diffuser section of the down stem.

A further object of a preferred embodiment of the present invention is to provide a hookah assembly having a removable tank top or lid which includes a peripheral or annular seal that contacts an upper/horizontal surface of a tank body or liquid housing/retaining member.

Still another object of a preferred embodiment of the present invention is to provide a hookah assembly having a peripheral or annular seal that surrounds and/or engages a metallic vertically extending interior peripheral/annular lip of the lid which extends into the interior storage space defined by a liquid retaining tank or housing member.

A further object of a preferred embodiment of the present invention is to provide a low profile and/or compact hookah assembly that can be readily disassembled for storage and/or cleaning.

Yet another object of a preferred embodiment of the present invention is to provide a tank or housing member for a hookah that includes a main body connected to opposing sidewalls wherein the upper surface of the main body is offset inwardly from uppermost surfaces of the opposing sidewalls allowing the tank top or lid to fit between and be protected by the opposing sidewalls while also reducing the size (e.g., height) of the hookah.

Yet a further object of a preferred embodiment of the present invention is to provide a hookah having a tank or liquid housing member which includes a main body formed from a single piece of bent transparent plastic sealing connected to opposing transparent sidewalls wherein the uppermost surface and lowermost surface of the main body are offset inwardly from uppermost and lowermost surfaces, respectively, of the opposing sidewalls wherein each opposing sidewall is provided with an annular protective member (e.g., rubber annular foot) that extends around the corresponding sidewall and prevents sliding of the unit and further prevents the hookah assembly from marking a structure supporting the hookah assembly.

Another object of a preferred embodiment of the present invention is to provide a tank top or lid with an o-ring and a protective covering member located at each of the corners of an enlarged opening of a liquid tank or housing member wherein the o-rings seal the corners and releasably lock the tank lid to the liquid tank or housing member so that the lid and housing member can be lifted as a single unit by gripping any portion of the lid or any portion of the housing member.

A further object of a preferred embodiment of the present invention is to provide a hookah assembly having a plurality of purge/exhaust slots or openings formed in an upper horizontally extending surface of the tank lid or top allowing purging of any residual vapor directly through an upper/horizontal surface of the tank lid or top.

Yet a further object of a preferred embodiment of the present invention is to provide a down stem of a hookah having a plurality of annular grooves having a groove width or height that is configured or dimensioned to receive an o-ring and a plurality of bores/openings are spaced around and extend horizontally through each of the annular grooves wherein the diameter of each of the horizontally extending openings/bores is greater than the width/height of the annular groove so that when an o-ring is seated in a corresponding annular groove or recess each horizontally extending opening/bore is divided or separated into two smaller bores/openings (i.e., an upper opening/bore and a lower opening/bore).

Still a further object of a preferred embodiment of the present invention is to provide a down stem having an integral diffuser and a ball valve moveable vertically in an internal bore of the down stem to isolate the material being smoked during a purge or exhaust step or process wherein a removable o-ring releasably retains the ball valve in the internal bore of the down stem, i.e., the ball valve can be readily removed upon removal of the o-ring.

Another object of a preferred embodiment of the present invention is to provide a hookah assembly having an exhaust or purge valve assembly including a plurality of exhaust/purge valves wherein the exhaust or purge valve assembly is formed at least in part by a bowl support, an upper, exterior surface of a tank lid or top and an interior, lower surface of the tank lid or top.

A further object of a preferred embodiment of the present invention is to provide a tank lid or top of the hookah assembly with a connector for connecting the hookah assembly to an inhalation tube, hose or conduit which is formed as one piece with an upper surface of the tank top and a lower metallic chamber that communicates with the hose connector and extends into the liquid tank or housing member wherein at least three sides of the lower metallic chamber are spaced inwardly from any sealing element.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to a hookah including a liquid retaining tank for retaining a liquid to filter a material that is smoked and a lid detachably connected to the liquid retaining tank. The lid has an exterior surface and an inner surface. The lid has one or more exhaust openings extending from the inner surface of the lid to the exterior surface of the lid through which a vapor in the liquid retaining tank can pass through the lid to be exhausted from the liquid retaining tank. A first member has a first portion extending above the exterior surface of the lid and a second portion extending below the inner surface of the lid. The first portion of the first member is configured to support a bowl storing a material to be smoked and the second portion of the first member is configured to be detachably connected to a stem which extends downwardly into a liquid in the liquid retaining tank.

Another preferred embodiment of the present invention is directed to a hookah including a liquid retaining tank for retaining a liquid to filter a material that is smoked. The liquid retaining tank has a horizontal surface and an opening in the horizontal surface. A lid is detachably connected to the liquid retaining tank. The lid has an upper surface and a lower surface. The lid includes a seal surrounding the opening in the horizontal surface of the liquid retaining tank and seats on the horizontal surface of the liquid retaining tank.

A further preferred embodiment of the present invention is directed to a hookah which includes a liquid retaining tank for retaining a liquid to filter a material that is smoked and a lid detachably connected to the liquid retaining tank. A stem is configured to extend into the liquid retained or housed by the liquid retaining tank. The stem includes a diffuser section having a plurality of annular grooves. Each of the grooves has a plurality of horizontally extending openings. The stem further includes a plurality of annular members. Each of the plurality of annular members extend into a corresponding annular groove of the plurality of annular grooves.

The preferred forms of the present invention described above provide various examples of preferred embodiments of the present invention and are not to be construed as limiting the present invention to any of the preferred forms described above in this section or any preceding or subsequent section.

DETAILED DESCRIPTION OF THE PREFERRED EMBODIMENT OF THE INVENTION

The preferred forms of the invention will now be described with reference to FIGS. 1-20. The appended claims are not limited to the preferred forms and no term and/or phrase used herein is to be given a meaning other than its ordinary meaning unless it is expressly stated otherwise. In particular, "a material that is smoked" includes any substance and/or material that can be smoked using the preferred embodiment of the present invention depicted in FIGS. 1-20 or any variation thereof.

The figures do not depict the bowl that supports, houses or contains the material or substance that is smoked or the inhalation hose, conduit, tube used to smoke the material or substance to be smoked, as these items can be of any suitable conventional form or later developed form that is compatible with the preferred forms of the present invention or any variation thereof.

Referring to FIGS. 1 to 20, the preferred form of the present invention includes a hookah assembly A having a liquid retaining tank B, a removable lid C, a down-stem D, a bowl support E and an exhaust or purge valve assembly F preferably housing multiple exhaust or purge valves. It should be noted in a preferred form of the present invention, the bowl support E forms a portion of the exhaust or purge valve assembly.

Removable lid or top C is configured such that when lid C is operably attached or connected to the liquid retaining tank B, the two components (i.e., lid C and tank B) can be raised as a single unit by a person gripping any portion of lid C or any portion of tank B. The feature or features that provide this preferred form of connection between tank B and lid C will be described and discussed below.

Figure 8:
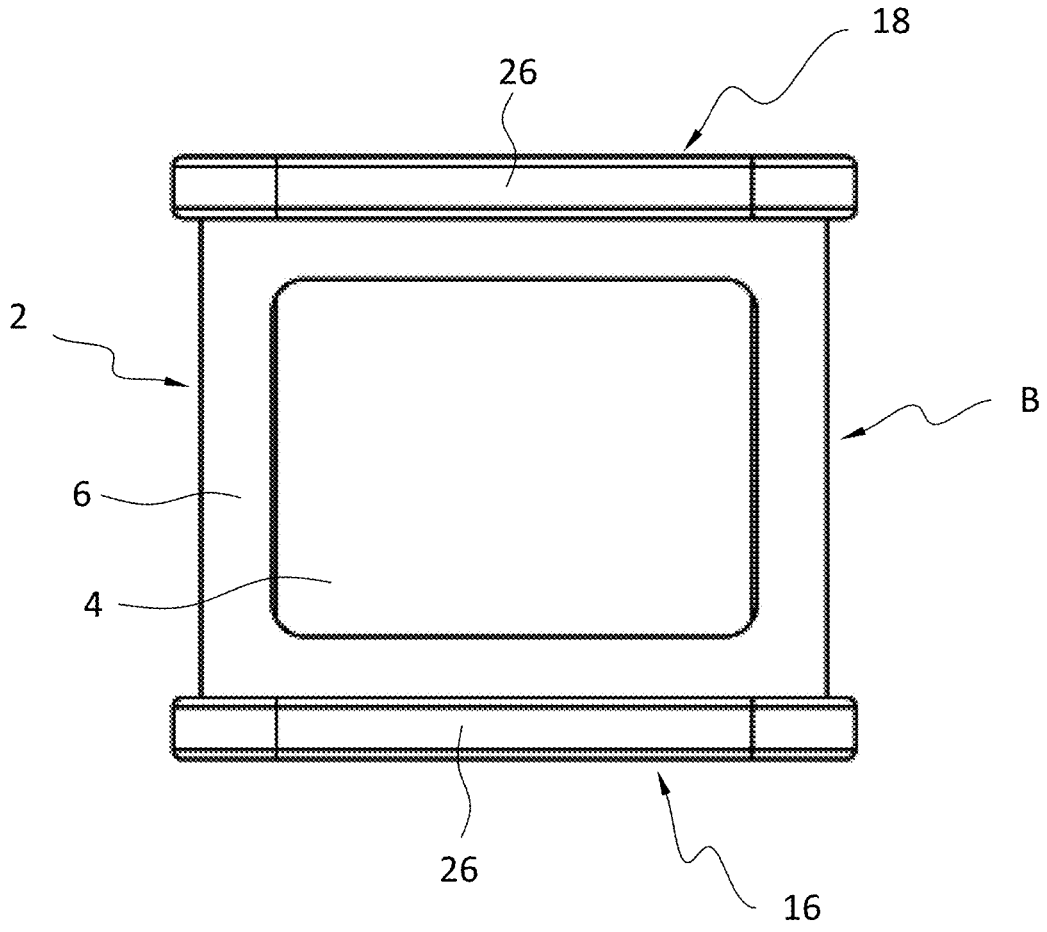
FIG. 8 is a top view of the liquid retaining tank of the hookah assembly of FIG. 1.
Figure 9:
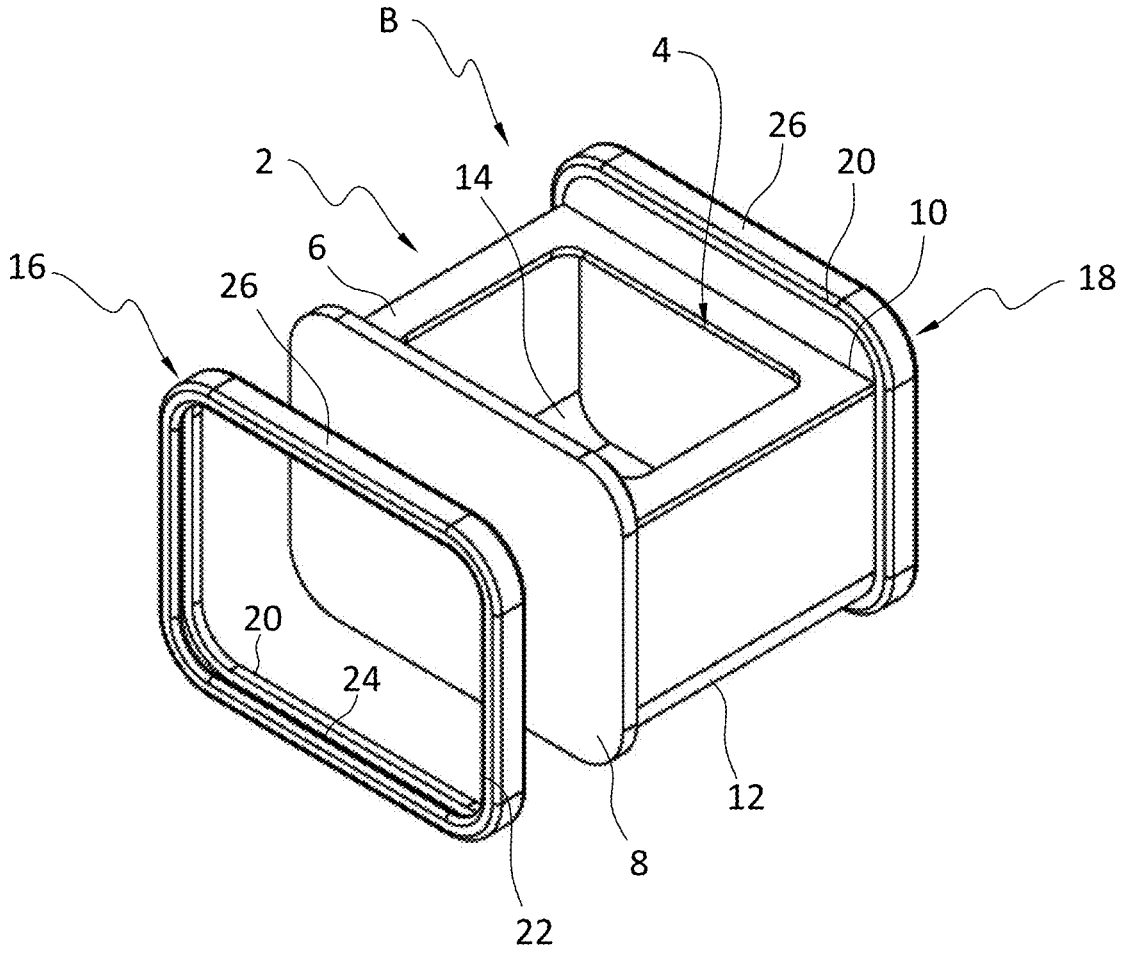
FIG. 9 is a partially exploded and perspective view of the liquid retaining tank depicted in FIGS. 1 and 8.

Referring to FIGS. 1 to 9, the liquid retaining tank B preferably houses and/or stores water or other suitable filtering liquid at a sufficient level to filter the material being smoked through the stored or housed liquid prior to the individual inhaling the smoke or vapor. As seen in FIGS. 8 and 9, tank B includes a main body or main section 2 having an enlarged central opening 4 formed in upper horizontally extending surface 6 of main body 2. Tank B can be readily filled to the desired level by pouring liquid into tank B through enlarged opening 4. For example, central opening 4 may be readily aligned with a sink faucet to fill tank B to the desired level water or liquid level. It should be noted that an upper portion of tank B should include only a gas or gas vapor, i.e., tank B is not to be completely filled with water or other suitable liquid.

Preferably, main section or body 2 is formed from a single piece of bent, transparent plastic, opposing ends of which are connected in a sealed manner using any suitable connecting technique (e.g., fusion bonding or any type of suitable welding including but not limited to ultrasonic welding, vibration welding or induction welding), material (e.g., any suitable adhesive or bonding substance) and/or mechanical fasteners. However, the main body 2 can be formed from any suitable material including but not limited to non-transparent plastics or metals. Further, the main body or section 2 can be formed from two or more pieces connected in a fluid tight manner with any suitable connection means or technique.

Tank B further includes left and right sidewalls 8 and 10 each preferably formed from a single piece of transparent plastic connected to the left and right sides, respectively, of main body 2, in a fluid tight manner using any suitable connecting technique or means. However, sidewalls 8 and 10 can be formed from any suitable transparent or non-transparent material. Preferably, sidewalls 8 and 10 are identical in configuration and size.

Figure 1:
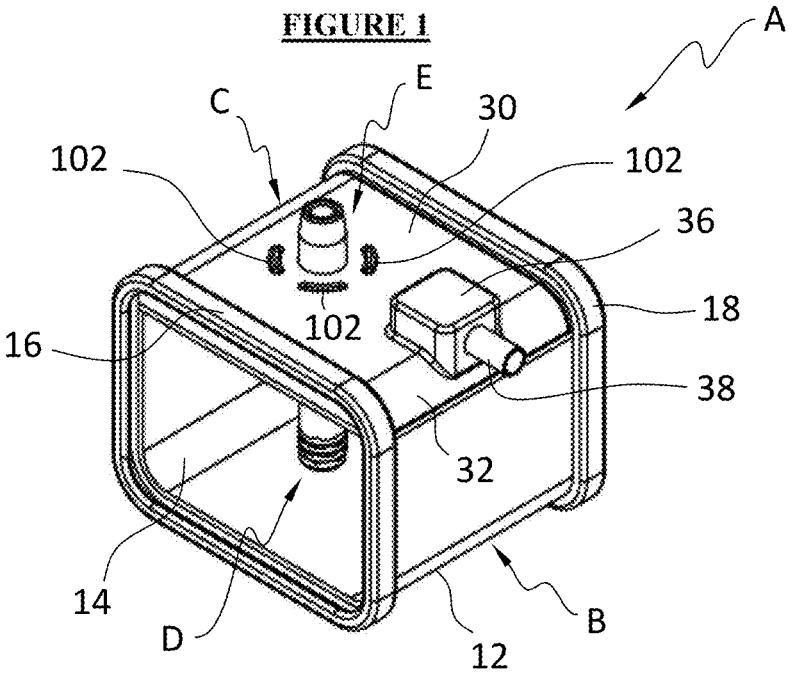
FIG. 1 is a perspective view of a hookah assembly with the smoking or inhalation hose/conduit/tube and the bowl for housing/containing/supporting a material to be smoked removed.
Figure 2:
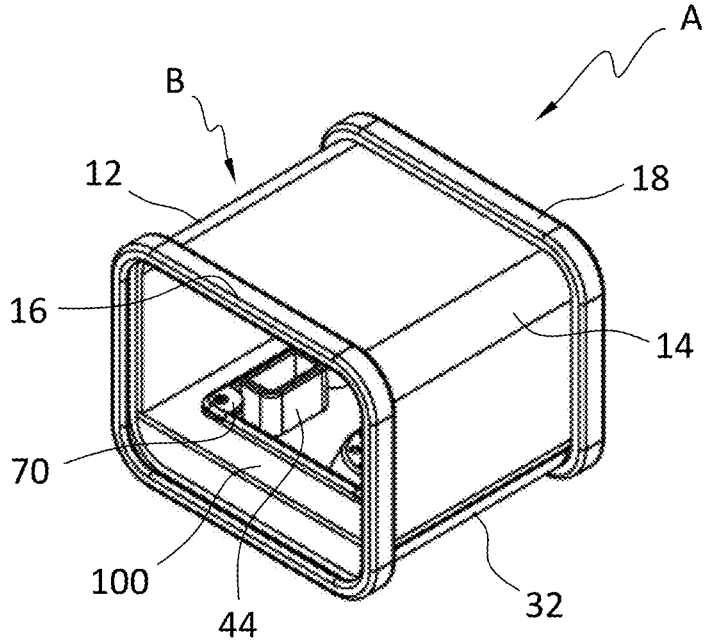
FIG. 2 is a perspective view of the hookah assembly of FIG. 1 as viewed from a bottom vantage point.
Figure 3:
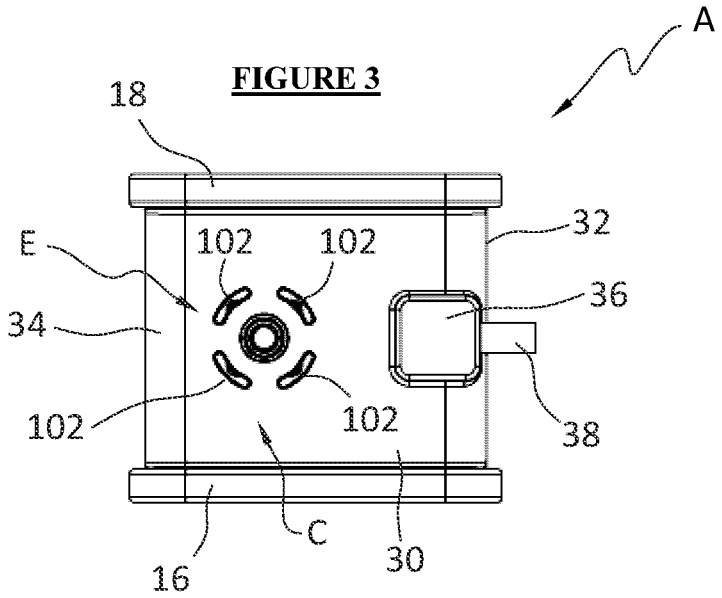
FIG. 3 is a top view of the hookah assembly of FIG. 1.
Figure 4:
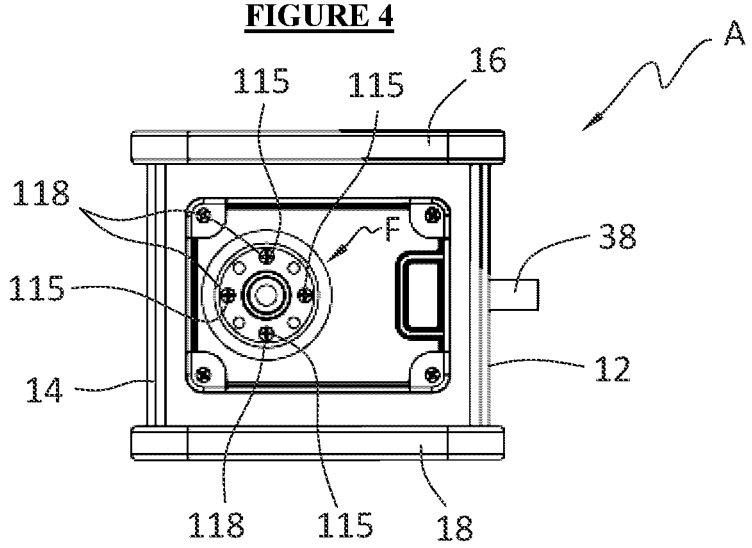
FIG. 4 is a bottom view of the hookah assembly of FIG. 1.
Figure 5:
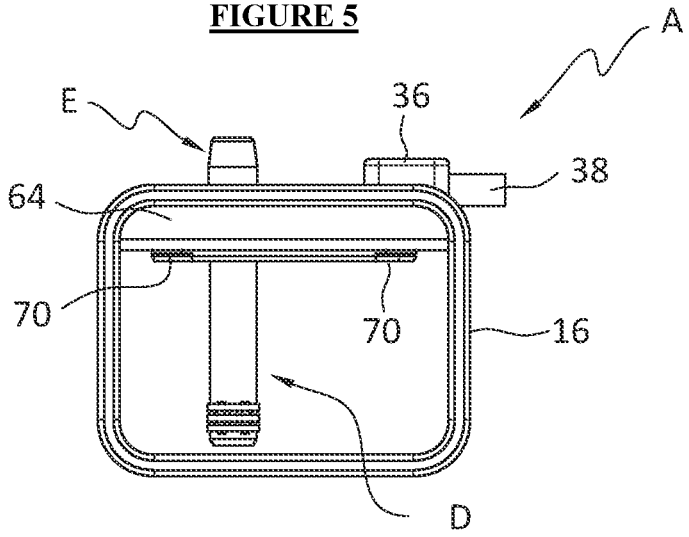
FIG. 5 is a left side elevational view of the hookah assembly of FIG. 1.
Figure 6:
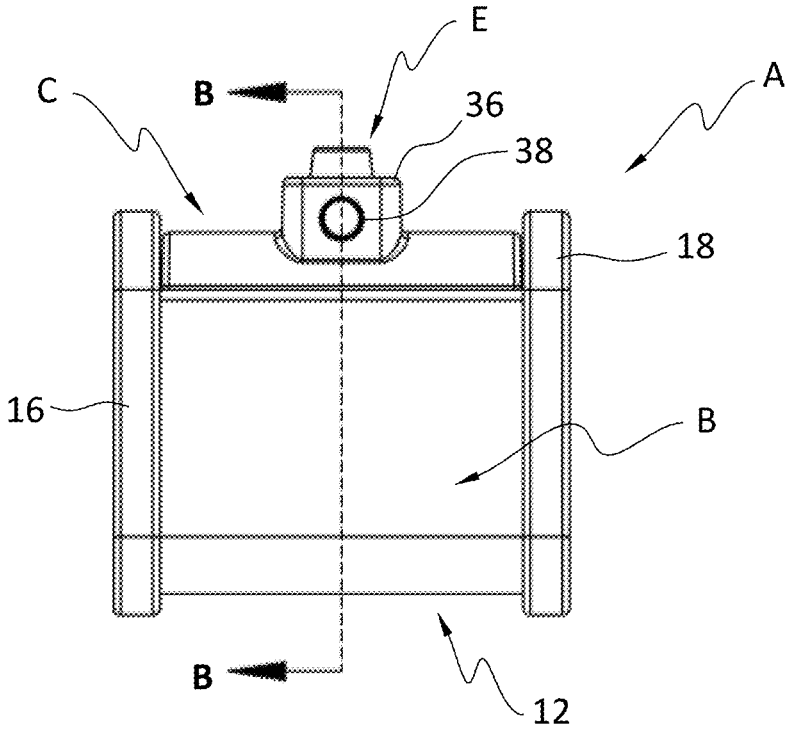
FIG. 6 is a front elevational view of the hookah assembly of FIG. 1.
Figure 7:
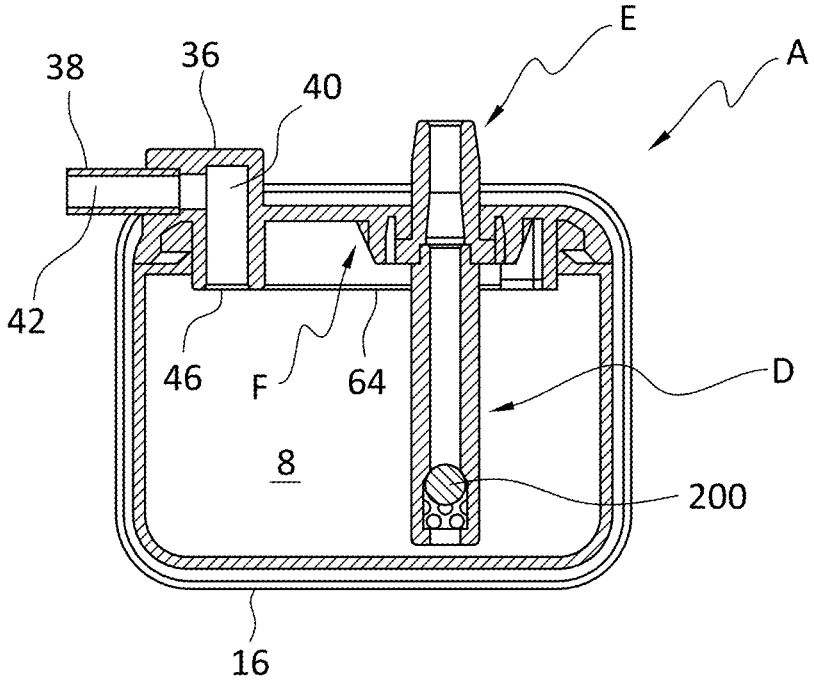
FIG. 7 is a cross-sectional view of the hookah assembly of FIG. 1 taken along lines B-B in FIG. 6.

Segments 12 and 14 forming the lower front and rear portions, respectively, of main body 2 can be arcuate, rounded or beveled to facilitate cleaning of tank B, as seen in, for example, FIGS. 1, 2 and 9. Preferably, the radius of curvature of segments 12 and 14 is identical or substantially identical. Tank B further includes left and right peripheral, anti-skid, protection members 16 and 18 mounted on and about sidewalls 8 and 10, respectively. Members 16 and 18 can be formed from any suitable material including rubber or other elastomeric material. Preferably, members 16 and 18 are identical allowing either member to be mounted on and about either sidewall. Each of members 16 and 18 preferably includes vertically extending inner and outer annular lips 20 and 22, respectively and an annular groove/recess 24 extending between annular lips 20 and 22 as is seen in, for example FIG. 9. An outer peripheral/annular portion of a corresponding sidewall seats in the annular groove 24 of the corresponding anti-skid, protection member. Outer lip 22 preferably directly engages or is positioned adjacent an outer vertically extending surface of a corresponding sidewall and inner lip 20 preferably directly engages or is positioned adjacent an inner vertically extending surface of a corresponding sidewall. Preferably, inner lip 20 extends parallel or substantially parallel to outer lip 22. Inner lip 20 and outer lip 22 preferably extend inwardly from outer surface 26 of the corresponding anti-skid, protection member. Preferably, outer lip 22 extends inwardly from outer surface 26 a distance greater than the distance inner lip 20 extends inwardly from outer surface 26.

Sidewalls 8 and 10 and members 16 and 18 can each be provided with four complimentary arcuate or rounded corner sections. Preferably, tank B is symmetrical or substantially symmetrical such that a vertical plane passing through a center of tank B and extending from segment 12 to segment 14 divides tank B into left and right symmetrical or substantially symmetrical portions and a vertically extending plane passing through a center of tank B and sidewalls 8 and 10 divides tank B into front and rear symmetrical or substantially symmetrical portions.

Preferably, upper and horizontally extending surface 6 (see FIGS. 8 and 9) of main body 2 is offset downwardly from an uppermost surface of each of sidewalls 8 and 10 and an uppermost surface of each of members 16 and 18.

Figure 10:
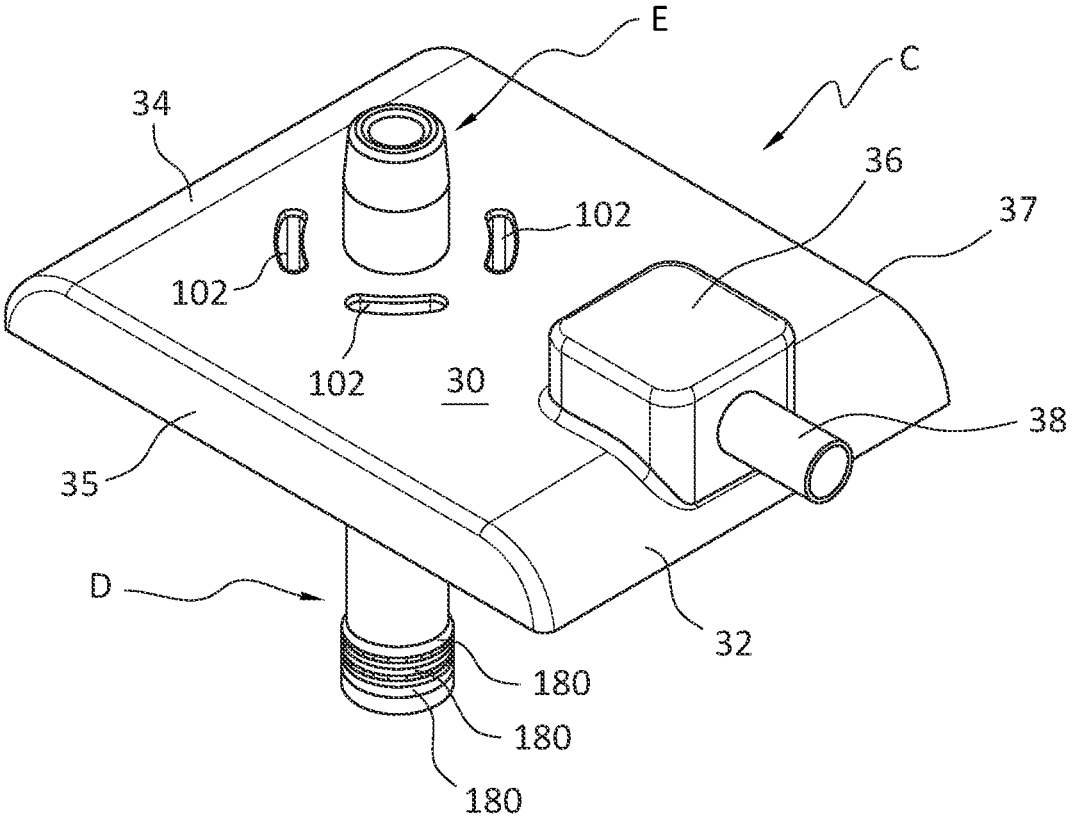
FIG. 10 is a perspective view of the hookah assembly of FIG. 1 with the liquid retaining tank removed.
Figure 12:
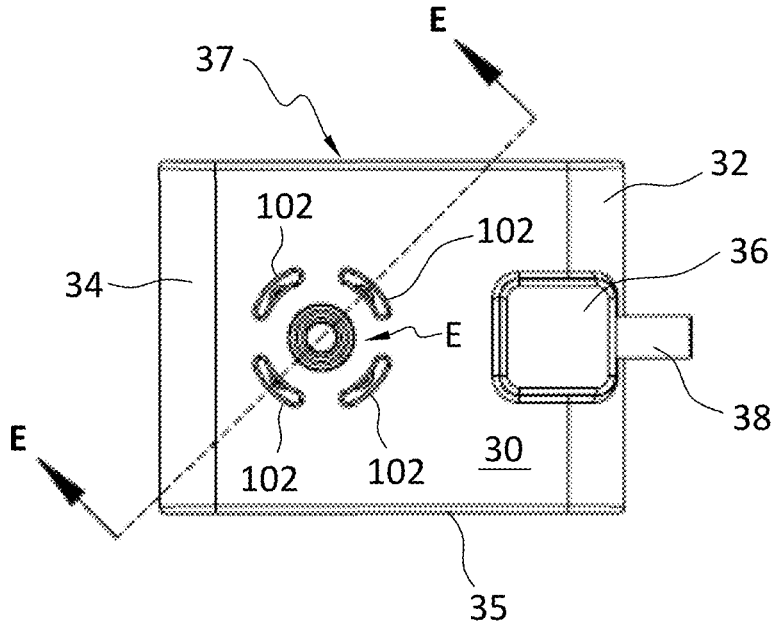
FIG. 12 is a top or plan view of the portion of the hookah assembly depicted in FIG. 10.
Figure 13:
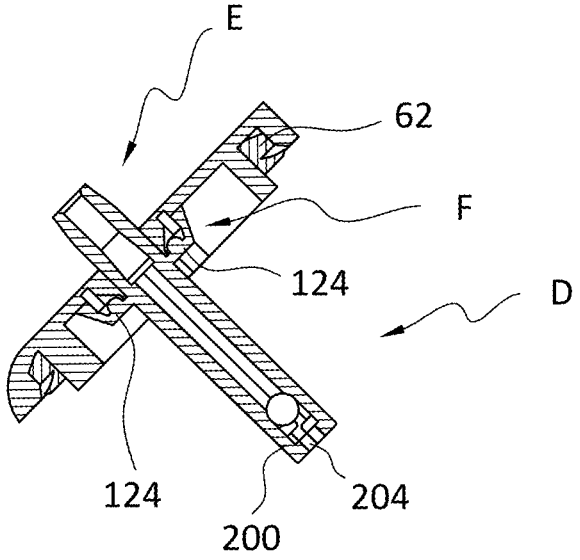
FIG. 13 is a cross-sectional view taken along lines E-E in FIG. 12.
Figure 14:
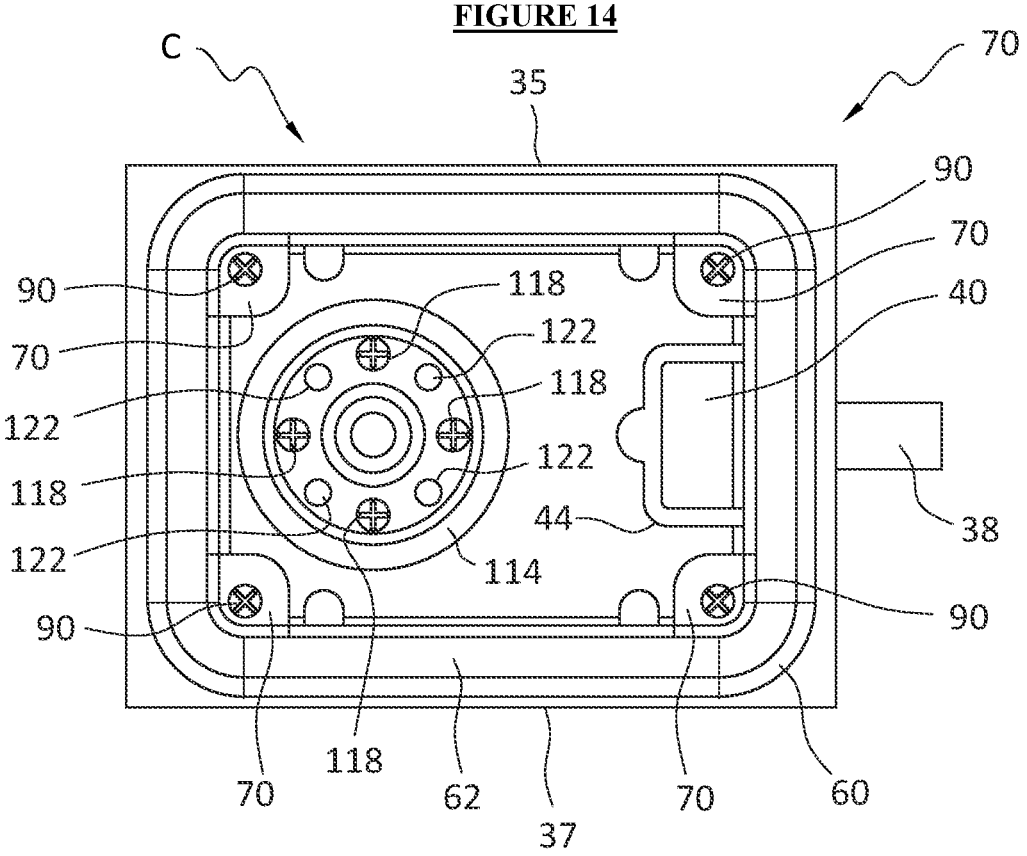
FIG. 14 is a bottom view of the portion of the hookah assembly depicted in FIG. 10.
Figure 15:
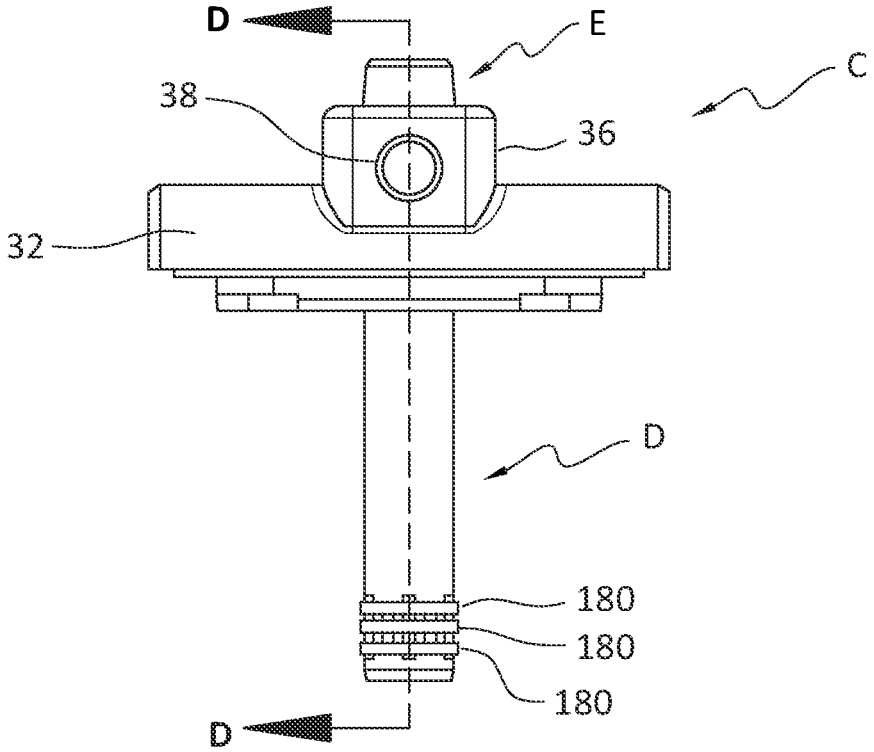
FIG. 15 is a front elevational view of the portion of the hookah assembly depicted in FIG. 10.

Removable lid C includes an upper, exterior surface 30 extending between arcuate front surface 32 and arcuate rear surface 34 and left and right sidewalls 35 and 37, respectively as seen in, for example, FIGS. 1, 10 and 12. Preferably, surface 30 is a horizontally extending or substantially horizontally extending surface. Arcuate surfaces 32 and 34 can have the same radius of curvature. Further, the radius of curvature of segments 12 and 14 can be the same as the radius of curvature of surfaces 32 and 34.

In a most preferred form, hookah assembly A is configured to resemble a military tank with members 16 and 18 resembling the continuous tracks of a military tank, raised section/segment 36 resembling a military tank's turret and connection conduit/port 38 resembling the gun/barrel of a military tank.

Figure 16:
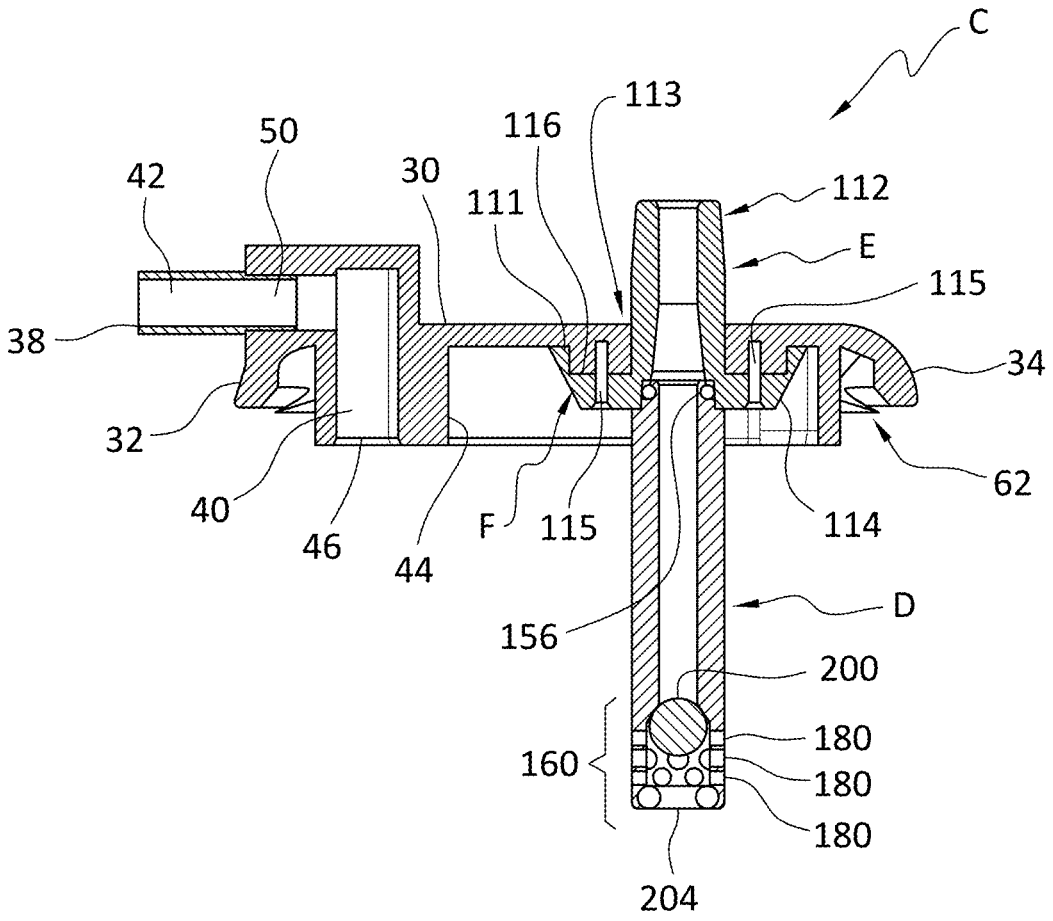
FIG. 16 is a cross-sectional view taken along lines D-D in FIG. 15.
Figure 17:
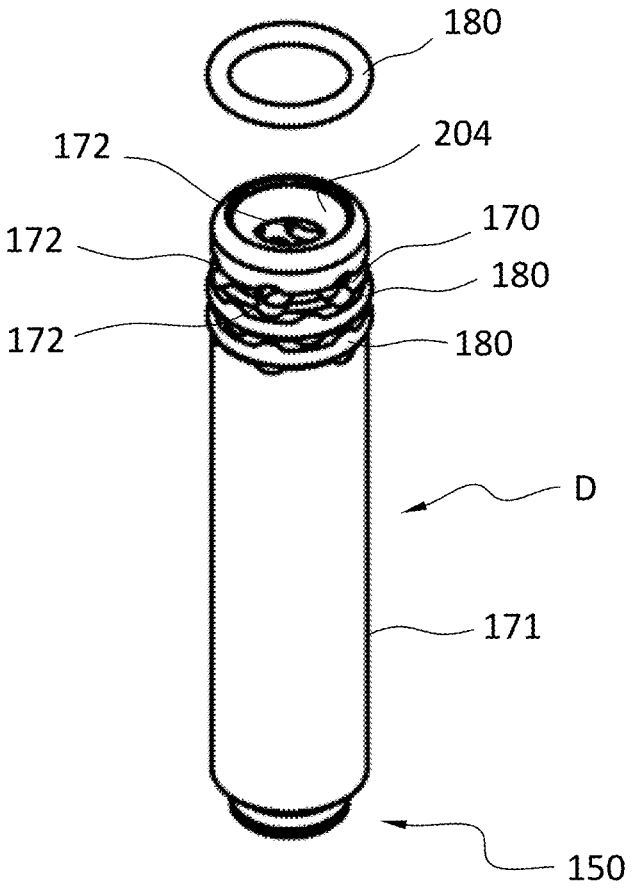
FIG. 17 is a partially exploded, perspective view of a preferred down-stem of the hookah assembly of FIG. 1.
Figure 18:
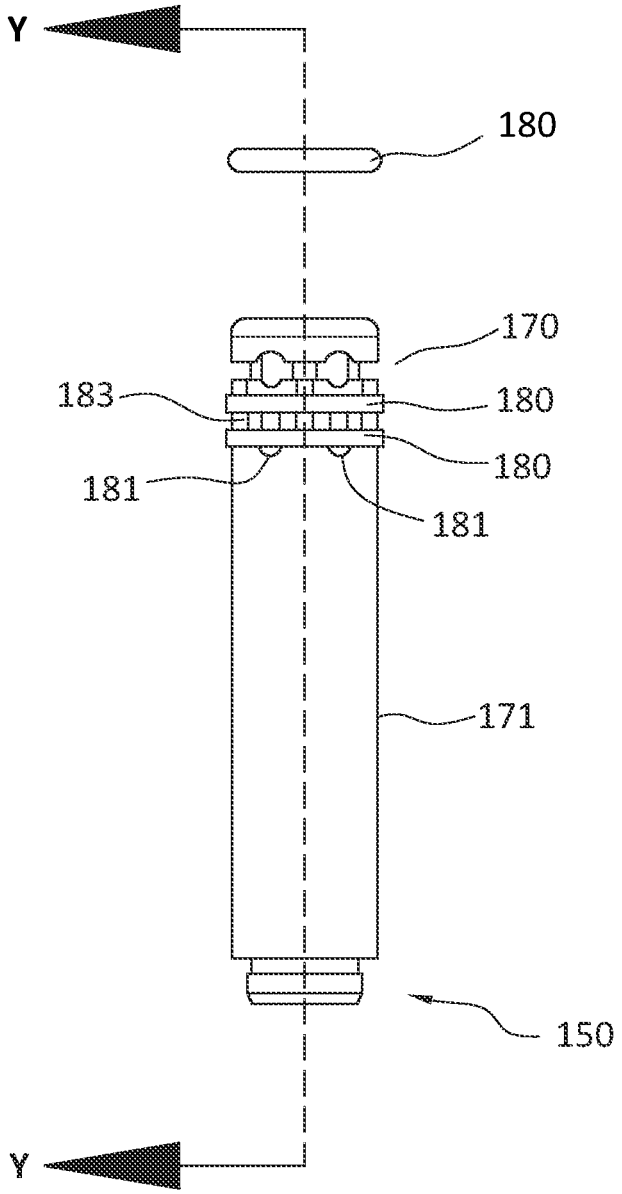
FIG. 18 is a partially exploded, front elevational view of the preferred down-stem of the hookah assembly depicted in FIG. 17.

An upper portion of interior chamber 40 formed by raised section 36 is in fluid communication with an internal cavity or bore 42 of conduit 38 which extends the length of conduit 38 as seen in, for example FIG. 16. A lower portion of interior chamber 40 is formed by inner section 44 extending downwardly from raised section 36. An inlet opening 46 is formed in the bottom of inner section 44 as is seen in, for example, FIG. 16. Conduit or port 38 preferably includes external threads 48 to detachably connect conduit 38 to raised section 36 at opening or internal bore 50 having complementary internal threads as seen in, for example, FIGS. 11, 11A and 16. This configuration allows an inhalation tube, hose or conduit to be detachably connected to conduit 38 so that an individual can inhale smoke or vapor in the liquid retaining tank B. The smoke or vapor travels upwardly from the tank B through chamber 40, bore 42 and the inner bore or cavity of the inhalation tube, hose or conduit to the mouth of the individual using the hookah assembly A.

Figure 11:
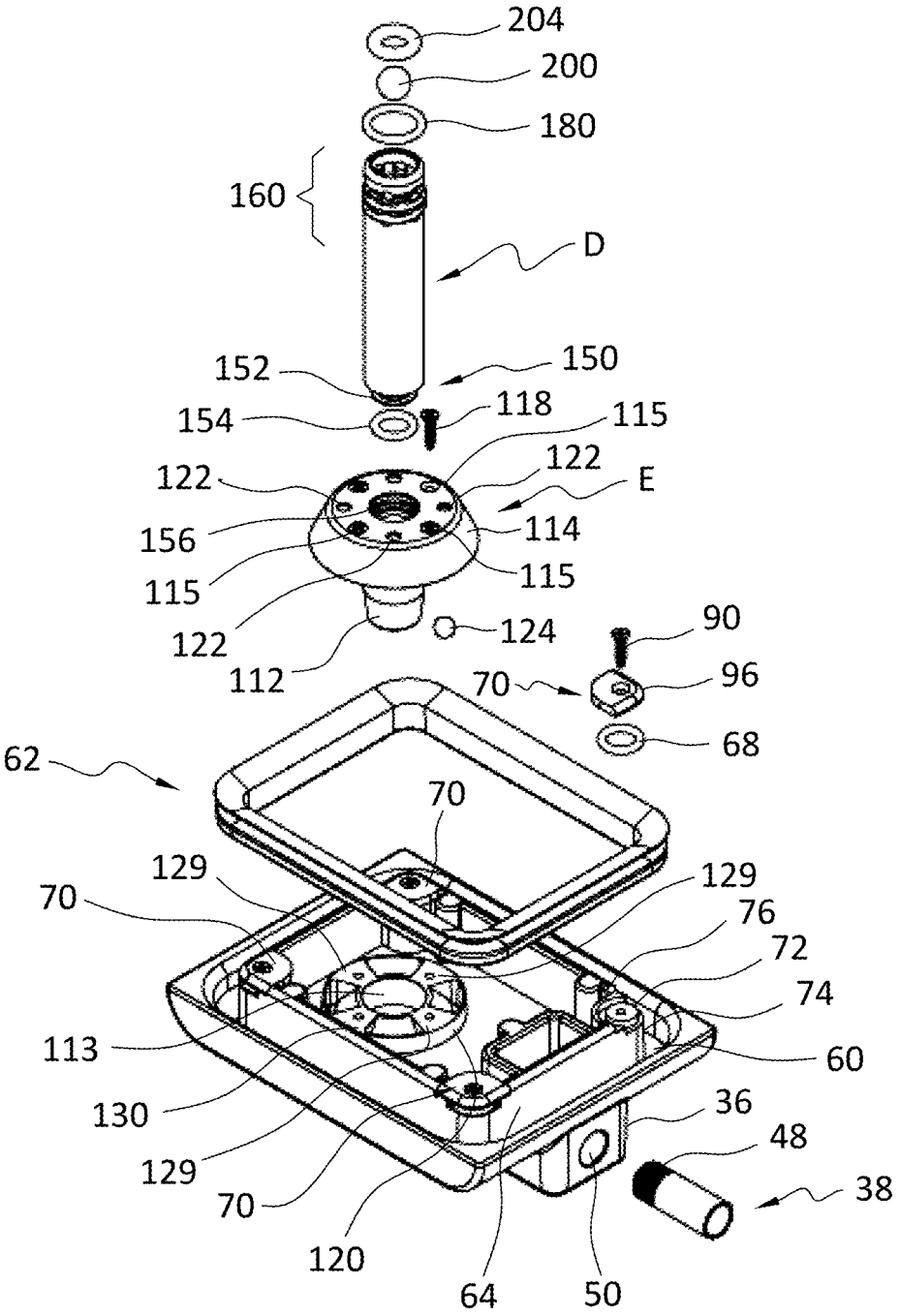
FIG. 11 is a partially exploded, perspective view of the portion of the hookah assembly depicted in FIG. 10 as viewed from a bottom vantage point.
Figure 11A:
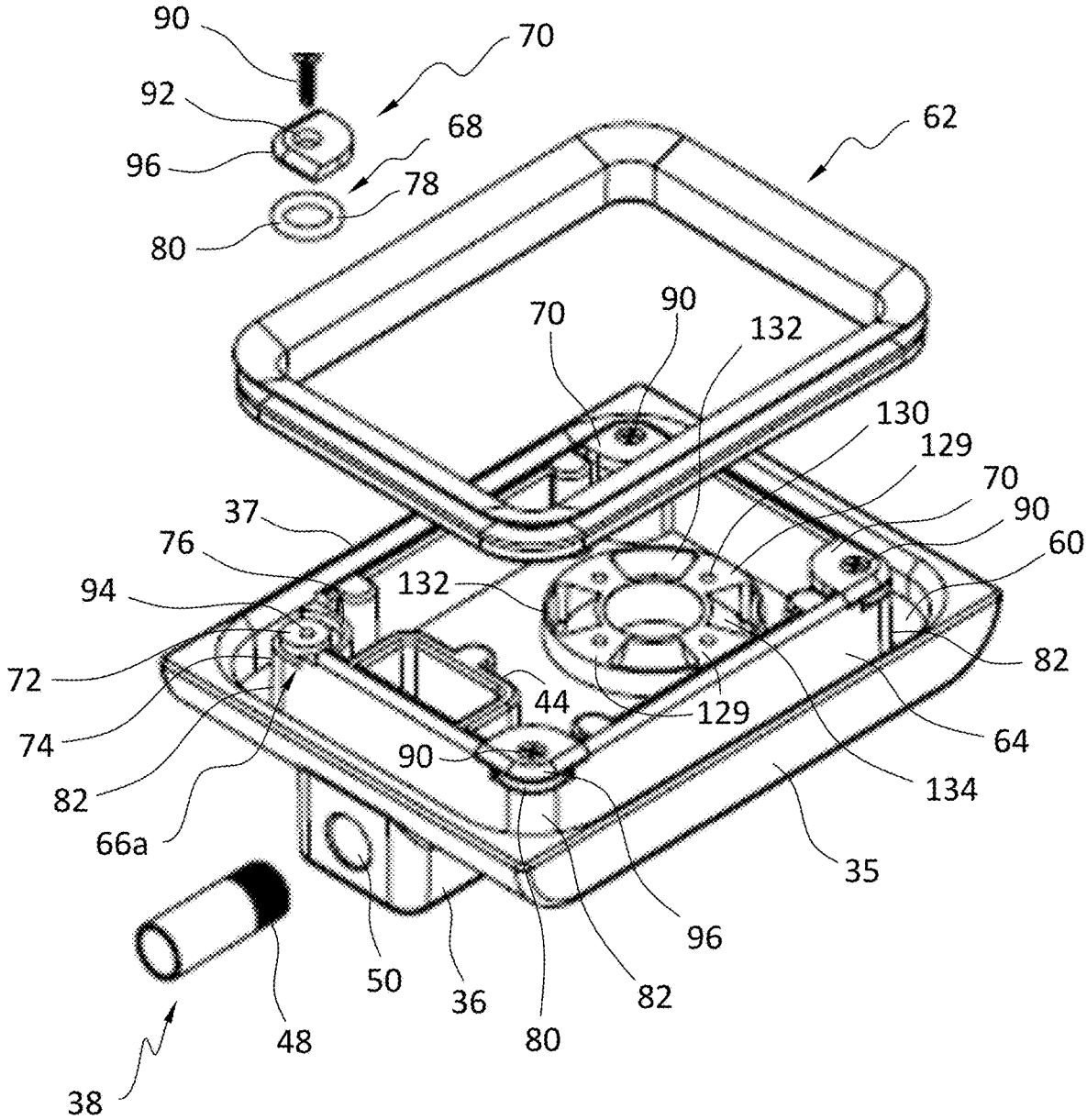
FIG. 11A is a partially exploded, perspective view of only some of the components depicted in FIG. 11.
Figure 20:
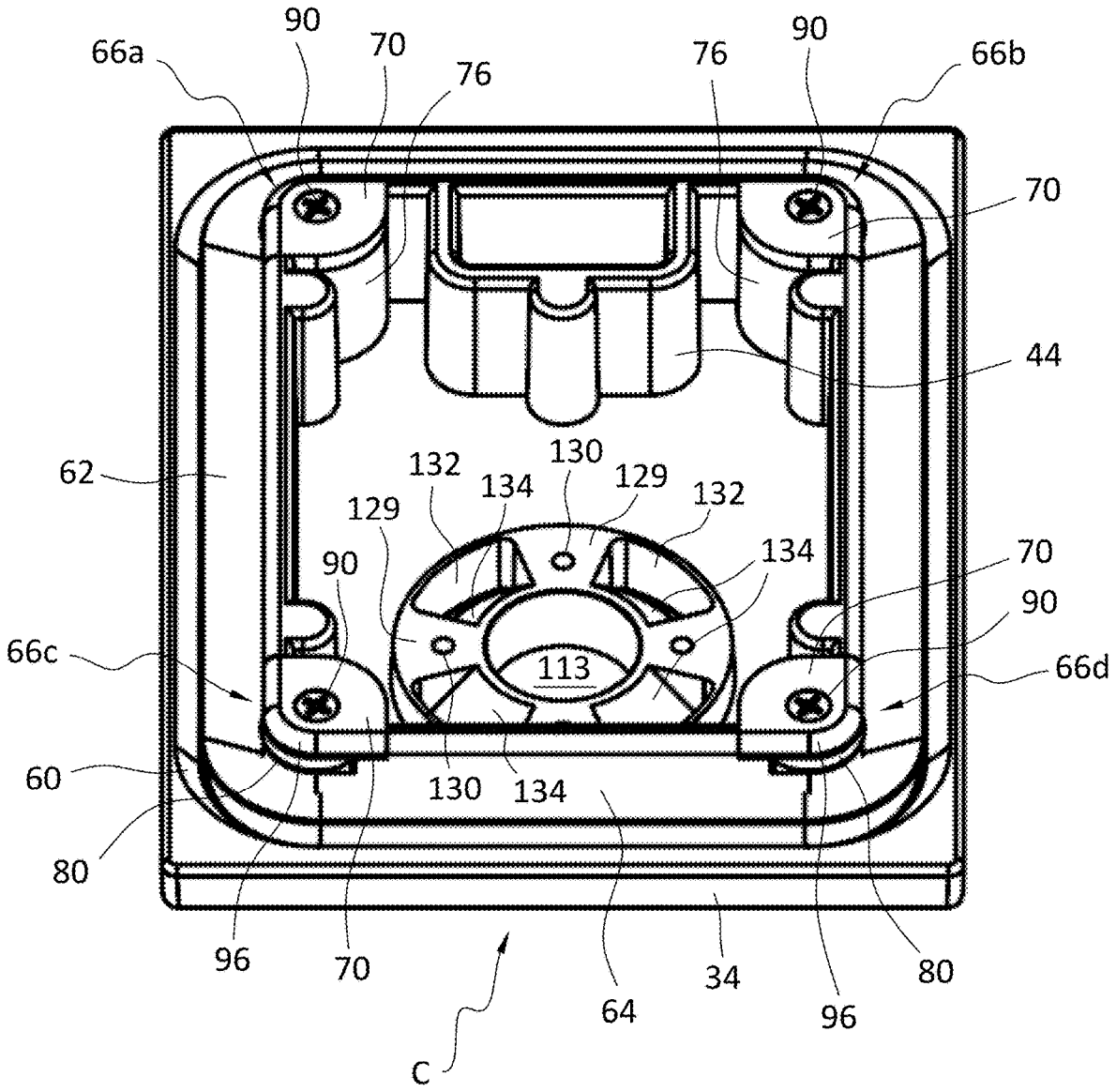
FIG. 20 is a bottom perspective view of a portion of the hookah assembly of FIG. 1.

Referring to FIGS. 11, 11A and 20, an annular groove 60 is formed on an inner surface of lid C. The annular groove or recess 60 is configured to receive annular seal 62 so that at least a portion of annular seal 62 seats in annular groove 60. Annular seal 62 surrounds and engages downwardly and vertically extending inner annular wall portion 64. Annular wall portion 64 extends into the chamber formed by tank B as seen in, for example, FIGS. 5 and 7.

The four corner sections 66*a*, 66*b*, 66*c* and 66*d* of annular wall portion 64 are each configured to receive and support an o-ring 68 or other sealing element and seal protection cover member 70. The corner sections 66*a*, 66*b*, 66*c* and 66*d* are configured identically or similarly and, therefore, only one corner section 66*a* will be described in detail.

Referring to FIGS. 11 and 11A, corner section 66*a* includes a cylindrical portion 72 and a seal seating and support surface 74 surrounding cylindrical portion 72. Cylindrical portion 72 extends upwardly from seal seating surface 74. Seal seating surface 74 extends horizontally or substantially horizontally and includes an arcuate outer edge and an arcuate inner edge O-ring 68 sits on surface 74 and surrounds and engages cylindrical portion 72. An interior and arcuate wall portion 76 extends around and upwardly from the inner arcuate edge of surface 74. The corresponding inner portion 78 of o-ring 68 directly engages or is positioned adjacent wall portion 76 so that wall portion 76 will prevent inward movement of inner portion 78 of o-ring 68 or restrict the amount of inward movement of portion 78 of o-ring 68. Outer portion 80 of o-ring 68 extends outwardly from the outer surface 82 of wall portion 64.

Cover member 70 sits on cylindrical portion 72 and is detachably connected thereto by a fastener 90. Cover member 70 includes an opening 92 for receiving fastener 90. Cylindrical portion 72 includes an internally threaded bore 94 having complementary threads to fastener 90 so that fastener 90 can detachably or removably connect cover member 70 and o-ring 68 to cylindrical portion 72. Outer portion 96 of cover member 70 is offset inwardly from portion 80 of o-ring 68 so that portion 80 of o-ring 68 extends outwardly from outer portion 96 of cover 70.

The orientation of outer portion 80 of each of the four o-rings 68 so that it extends outwardly from both surface 82 and portion 96 allows outer portion 80 of o-rings 68 to engage the adjacent corner portion of inner surface 100 (see FIG. 2) of main body 2 to releasably lock a corresponding corner of lid C to a corresponding portion of tank B. The resilient nature and/or the configuration and sizing of each of the four o-rings 68 allows an individual to remove lid C from tank B by moving lid C (e.g., sliding lid C in a horizontal plane and in a direction parallel to sidewalls 8 and 10) relative to tank B to free one or more of the o-rings 68 (e.g., free two o-rings 68) from the corresponding portions of tank B to allow the lid C to be removed from tank B. For example, sliding lid C in a forward direction parallel to sidewalls 8 and 10 will free the two o-rings 68 disposed adjacent the two opposing rear corners (i.e., the corners closet to arcuate surface 34) of enlarged opening 4. This sliding movement may but does not necessarily compress the two o-rings 68 disposed adjacent the two opposing front corners of enlarged opening 4 (i.e., the corners closer to raised section 36 and arcuate surface 32).

When all four o-rings 68 engage the corresponding adjacent corner portion of inner surface 100 (see FIG. 2), lid C and tank B may be raised as a unit by merely lifting any portion of lid C (e.g., by gripping only raised section 36 or only conduit 38) or any portion of tank B. When connected in this manner, annular seal 62 seats on upper surface 6 of main body 2. This sealing engagement prevents fluid from entering or exiting tank B through the peripheral or outer portion of enlarged opening 4.

In the preferred embodiment, a plurality of arcuate exhaust slots 102 (e.g., four arcuate slots) surround bowl support E and extend through lid C as seen in, for example, FIGS. 1, 3, 10 and 12. Preferably, the four slots 102 are equidistantly spaced about bowl support E. However, the number, shape and spacing of openings 102 can be readily varied as desired. As explained in more detail below, an exhaust valve is operably associated with each of the openings 102 so that openings 102 are normally closed preventing a fluid from entering or exiting tank B through openings 102. The exhaust valves are configured to open when an individual blows air into the inhalation hose, conduit or tube during a purge process to allow residual vapor or other fluid to be exhausted or purged from tank B directly through lid C via openings 102.

Referring to FIG. 11, bowl support E is illustrated in an inverted position. Bowl support E includes an inwardly tapered annular portion 112 which is configured to support a bowl of tobacco or other substance and extend upwardly through opening 113 in lid C. Annular portion 112 may be formed from a tapered tubular piece of metal surrounded by a tapered rubber seal which contacts and seals the area between the tapered tubular piece of metal and an adjacent portion of upper surface 30 lid C. Bowl support E further includes an outer, annular wall or lip portion 114 which is spaced outwardly from and surrounds portion 112. An annular groove or recess 111 is formed between outer, annular wall portion 114 and tapered annular portion 112 having a seating surface 116 as seen in, for example, FIG. 16. Four small bores 115 preferably extend through the seating or bottom surface 116 of bowl support E to receive fasteners 118 to detachably connect bowl support E to downwardly extending annular member 120 of lid C for forming a section or segment of exhaust valve assembly F as seen in, for example, FIGS. 11 and 16.

Four through bores 122 are preferably provided with each bore 122 disposed between adjacent bores 115 and extending through the corresponding portion of bowl support E. Preferably, the upper end of each of bores 122 are larger than the lower ends of bores 122 so that a sealing ball 124 or other sealing element can be inserted into each of the bores 122 through the upper end. The lower end of each of bores 122 is smaller than the sealing ball 124 to retain the sealing ball 124 in the corresponding bore 122 of bowl support E.

Annular member 120 of lid C includes four horizontally extending surfaces 129 each having a threaded opening 130 configured to receive a corresponding one of the four fasteners 118 to detachably connect bowl support E to annular member 120 as seen in, for example, FIGS. 11 and 11A. Annular member 120 includes four elongated arcuate slots, recesses or depressions 132 that are in fluid communication with a corresponding slot 102 as seen in, for example, FIGS. 11, 11A and 20. Each slot, recess or depression 132 includes an outwardly inclined inner surface 134.

The down-stem and integral diffuser D will now be described in detail. Down-stem D preferably includes an upper end 150 having an annular recess or groove 152 which receives o-ring 154 as seen in, for example FIG. 11. O-ring 154 seats in annular groove 156 of bowl support E to detachably connect down stem D to bowl support E, i.e., o-ring 154 expands outwardly to seat in annular groove 156 of bowl support E. Down-stem D includes a lower end 160 which is preferably configured to extend into the liquid housed or retained by tank B.

Lower end 160 is preferably a diffuser which diffuses the smoke or vapor to be inhaled through the water or other suitable liquid housed or stored in tank B. Preferably, lower end 160 includes three annular grooves or recesses 170 as seen in, for example FIG. 19. A single piece of metal or other suitable material forms external housing 171 and internal bore 173 of the down stem and integral diffuser with internal bore 173 extending vertically and completely through the down stem D. A plurality of horizontally extending openings 172 having a diameter greater than the width or height of grooves 170 extend through lower end 160 and a corresponding groove 170 to communicate with internal bore 173 as seen in, for example, FIG. 19. An o-ring 180 preferably seats in each of the annular grooves or recesses 170. The o-rings 180 act to divide or separate the horizontally extending openings 172 into upper and lower openings 181 and 183, respectively, having a smaller size than any one of the opening 172. This arrangement significantly reduces the size and number of openings that need to be formed in the diffuser section of the down stem D. This arrangement is advantageous as the smaller openings created by the o-rings 180 significantly reduce the noise caused by the operation of hookah assembly A. Further, o-rings 180 act to divert the smoke or vapor along different paths from the path of a purely horizontally extending opening.

Figure 19:
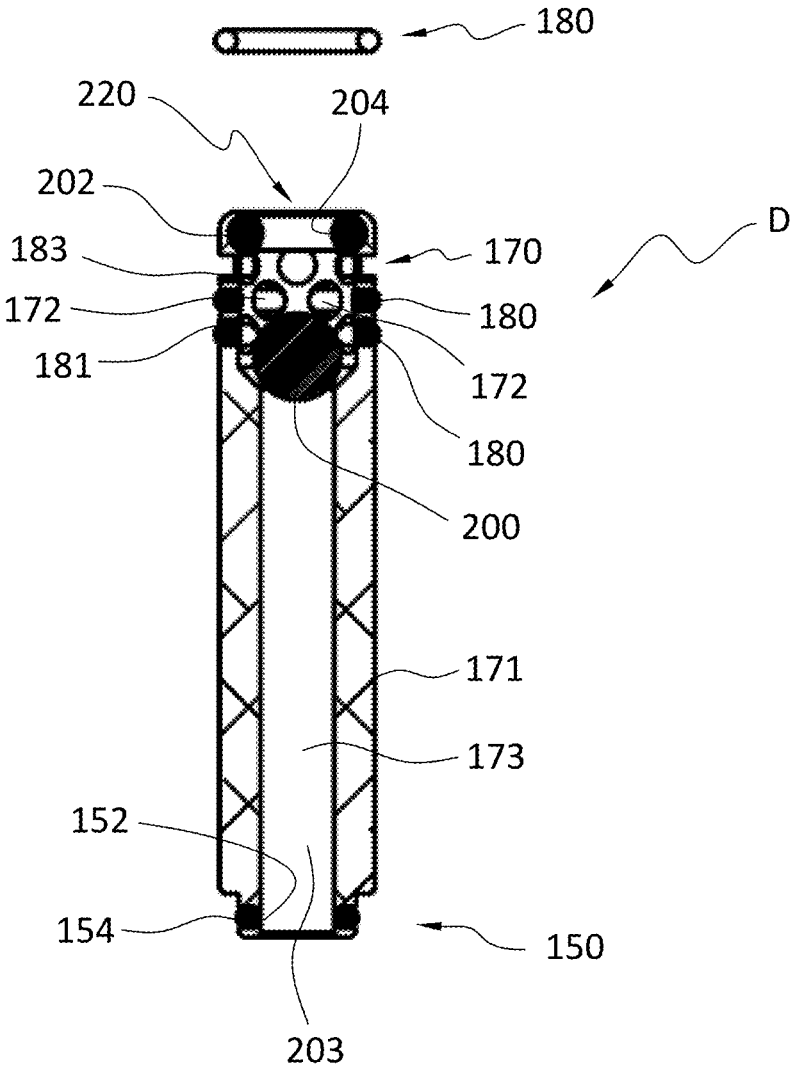
FIG. 19 is a cross-sectional view taken along lines Y-Y in FIG. 18.

Referring to FIG. 19, down stem D includes a ball valve 200 which is designed or configured to move vertically in lower section 202 of internal bore 173 of down stem D. As seen in FIG. 19, lower section 202 has an internal diameter greater than upper section 203 of internal bore 173. In FIG. 19, ball valve 200 is depicted in a closed position or uppermost position which occurs during an exhaust or purge process or step. In a normal state of operation, ball valve 200 rests in the lowermost end of down stem D allowing vapor to pass downwardly through internal bore 173 and out through the upper and lower openings formed by the o-rings 180 and into the water or other liquid housed in the liquid retaining tank B. Down stem D includes an o-ring 204 which seats in an internal annular groove 206 formed in a bottom portion of section 160 and removably retains ball valve 200 of down stem D, i.e., upon removal of o-ring 204, ball valve 200 can be readily removed from down stem D.

During normal operation, an inhalation tube, hose or conduit is connected to port 38, and tank B is filled with water or other suitable fluid so that lower section 160 of down stem D is disposed or submerged in water or other suitable fluid. The substance to be smoked is mounted on or about an upper portion of the bowl support E. The material to be smoked is then ignited. The vapor of the material being smoked is drawn downwardly through the bowl support E and out open end 220 and/or the upper and lower horizontally extending openings/bores of down stem D and is filtered by the water or other liquid in tank B. During this process, ball valves 124 of the purge or exhaust assembly F are seated in a closed position so that air surrounding the hookah assembly A cannot pass into tank B through slots 102. The vapor then passes upwardly through the liquid in tank B and opening 46 of chamber 44, raised section 36, port 38 and the inhalation tube, hose or conduit connected to port 36 into the mouth of an individual using hookah assembly A. During this smoking operation or process, ball valve 200 is in a lowermost or open position directly adjacent o-ring 204.

When an individual seeks or wants to exhaust or purge residual vapor or smoke in tank B, the individual need merely blow into the inhalation tube, which in turn causes each of the four balls 124 of the purge or exhaust assembly F to move upwardly off of the seated or closed position to allow vapors in the tank B to be directly exhausted or purged through slots or openings 102 formed in upper surface 30 of lid C. Arcuate slots 132 allow balls 124 to travel a sufficient distance from the seated or closed position to allow the purging or exhausting of any residual vapor or smoke from tank B. This processes also causes ball valve 200 to move upwardly to seal down stem D so that no fluid can travel upwardly through down stem D which prevents any fluid (e.g., water) from contaminating the material to be smoked which is supported by bowl support E.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. A hookah, comprising:

(a) a liquid retaining tank for retaining a liquid to filter a material that is smoked;

(b) a lid detachably connected to said liquid retaining tank, said lid having an exterior surface and an inner surface, said lid having one or more exhaust openings extending from said inner surface of said lid to said exterior surface of said lid through which a vapor in said liquid retaining tank can pass through said lid to be exhausted from said liquid retaining tank;

(c) a first member having a first portion extending above said exterior surface of said lid and a second portion extending below said inner surface of said lid; said first portion of said first member being configured to support a bowl storing a material to be smoked and said second portion of said first member being configured to be detachably connected to a stem which extends downwardly into a liquid in said liquid retaining tank; and, (d) said hookah further including at least one of the following:

(i) said exterior surface of said lid including a plurality of arcuate slots extending around said first portion of said first member; and, (ii) said second portion of said first member including at least one opening and an exhaust valve element for sealing said at least one opening, wherein said exhaust valve element is configured to be dislodged from said at least one opening when air is directed upwardly through said liquid retaining tank to exhaust vapor in said liquid retaining tank.

2. The hookah of claim 1, wherein:

said exterior surface of said lid includes said plurality of arcuate slots extending around said first portion of said first member.

3. The hookah of claim 1, wherein:

said second portion of said first member includes said least one opening and an exhaust valve element for sealing said at least one opening, wherein said exhaust valve element is configured to be dislodged from said at least one opening when air is directed upwardly through said liquid retaining tank to exhaust vapor in said liquid retaining tank.

4. The hookah of claim 3, wherein:

said second portion of said first member includes a plurality of openings and a plurality of exhaust valve elements, each of said plurality of exhaust valve elements being configured to seat on and seal a different one of said plurality of openings, wherein each of said plurality of exhaust valve elements are configured to be dislodged from a corresponding opening when air is directed upwardly through said liquid retaining tank so that the corresponding opening is in fluid communication with at least one of the one or more exhaust openings to allow vapor in said liquid retaining tank to be exhausted from the liquid retaining tank.

5. The hookah of claim 4, wherein:

said lid includes one or more lid sealing elements and said second portion of said first member is offset inwardly from said one or more lid sealing elements.

6. The hookah of claim 5, wherein:

said liquid retaining tank includes a horizontal surface, said one or more lid sealing elements include a first sealing element connected to said lid which engages the horizontal surface of said liquid retaining tank.

7. The hookah of claim 6, wherein:

said liquid retaining tank includes at least one supporting surface, said horizontal surface of said liquid retaining tank is offset inwardly from the at least one supporting surface of said liquid retaining tank.

8. The hookah of claim 7, wherein:

said at least one supporting surface of said liquid retaining tank includes an anti-sliding member configured to prevent said liquid retaining tank from sliding on a surface supporting said liquid retaining tank.

9. A hookah, comprising:

(a) a liquid retaining tank for retaining a liquid to filter a material that is smoked, said liquid retaining tank having a horizontal surface and an opening in said horizontal surface; and, (b) a lid detachably connected to said liquid retaining tank, said lid having an upper surface and a lower surface, said lid having a seal surrounding said opening in said horizontal surface of said liquid retaining tank and seating on said horizontal surface of said liquid retaining tank, said lid includes a lip configured to extend into said opening in said horizontal surface of said liquid retaining tank such that a lowermost portion of said lip is disposed below a lowermost portion of said seal.

10. The hookah of claim 9, wherein:

said lip extends downwardly and vertically wherein at least a portion of said lip extends below said opening in said horizontal surface of said liquid retaining tank.

11. The hookah of claim 10, wherein:

said seal is offset outwardly from said downwardly and vertically extending lip and surrounds said downwardly and vertically extending lip.

12. The hookah of claim 11, wherein:

said opening in said horizontal surface includes a plurality of corners and said lid includes a plurality of o-rings, each of said plurality of o-rings is configured to engage and seal a different one of the plurality of corners and connect the lid to the liquid retaining tank such that lifting of the lid will lift the liquid retaining tank with the lid when the lid is connected to the liquid retaining tank.

13. The hookah of claim 12, wherein:

a protective element is provided for each of said plurality of o-rings, said protective element being disposed below the corresponding o-ring.

14. A hookah, comprising:

(a) a liquid retaining tank for retaining a liquid to filter a material that is smoked;

(b) a lid detachably connected to said liquid retaining tank;

(c) a stem configured to extend into the liquid retained by said liquid retaining tank; said stem including a diffuser section having a plurality of annular grooves, each of said grooves having a plurality of horizontally extending openings, said stem further including a plurality of annular members, each of said plurality of annular members extending into a corresponding annular groove of said plurality of annular grooves.

15. The hookah of claim 14, wherein:

said annular members cover a central portion of corresponding horizontally extending openings wherein an upper portion and a lower portion of corresponding horizontally extending openings are unobstructed by a corresponding annular member to allow a fluid to pass through said upper portion and said lower portion of corresponding horizontally extending openings.

16. The hookah of claim 15, wherein:

said annular members are o-rings.

17. The hookah of claim 16, wherein:

the stem is configured to be detachably connected to a bowl support.

18. The hookah of claim 17, wherein:

the stem includes a valve for preventing liquid from contaminating a material to be smoked in a bowl.

19. The hookah of claim 18, wherein:

said liquid retaining tank includes a horizontal surface having an opening, said lid includes an upper surface and a lower surface, said lid further includes a seal surrounding said opening in said horizontal surface of said liquid retaining tank and seating on said horizontal surface of said liquid retaining tank.

20. The hookah of claim 19, wherein:

said opening in said horizontal surface includes a plurality of corners and said lid includes a plurality of o-rings, each of said plurality of o-rings is configured to engage and seal a different one of the plurality of corners and connect the lid to the liquid retaining tank such that lifting of the lid will lift the liquid retaining tank with the lid when the lid is connected to the liquid retaining tank.

* * * * *